US010884364B2

(12) United States Patent
Suzuki et al.

(10) Patent No.: US 10,884,364 B2
(45) Date of Patent: Jan. 5, 2021

(54) IMAGE HEATING APPARATUS AND IMAGE FORMING APPARATUS HAVING AN INTERMEDIATE MEMBER FIXED TO A TERMINAL AND FIXED TO AN ELECTRODE AT REGIONS SHIFTED FROM EACH OTHER

(71) Applicant: CANON KABUSHIKI KAISHA, Tokyo (JP)

(72) Inventors: Takafumi Suzuki, Suntou-gun (JP); Kazushi Nishikata, Tokyo (JP); Kenichi Nakao, Suntou-gun (JP); Makoto Komatsuzaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/704,374

(22) Filed: Dec. 5, 2019

(65) Prior Publication Data

US 2020/0192260 A1 Jun. 18, 2020

(30) Foreign Application Priority Data

Dec. 12, 2018 (JP) ..... 2018-232863

(51) Int. Cl.
*G03G 15/20* (2006.01)

(52) U.S. Cl.
CPC ..... *G03G 15/2053* (2013.01); *G03G 15/2028* (2013.01); *G03G 15/2064* (2013.01)

(58) Field of Classification Search
CPC ..... G03G 21/1652; G03G 15/20
See application file for complete search history.

(56) References Cited

U.S. PATENT DOCUMENTS

| | | | | |
|---|---|---|---|---|
| 5,753,889 | A * | 5/1998 | Kondo | G03G 15/2064 219/216 |
| 9,845,714 | B2 * | 12/2017 | Mori | F01N 3/2013 |
| 9,880,500 | B2 | 1/2018 | Aiba et al. | |
| 2019/0204768 | A1 | 7/2019 | Aiba et al. | |

FOREIGN PATENT DOCUMENTS

| | | | |
|---|---|---|---|
| JP | 04-351877 | A | 12/1992 |
| JP | 06-084584 | A | 3/1994 |
| JP | 2003-142232 | A | 5/2003 |

* cited by examiner

*Primary Examiner* — Arlene Heredia
(74) *Attorney, Agent, or Firm* — Venable LLP

(57) ABSTRACT

An image heating apparatus includes a heater that includes a substrate having a longitudinal direction arranged in a direction orthogonal to a direction in which a recording material is transported, a heat-generating element provided in the substrate, and an electrode configured to feed electric power to the heat-generating element, and a terminal to be electrically connected to the electrode, wherein an image formed on the recording material is heated by heat from the heater. A conductive intermediate member including at least one layer is provided between the terminal and the electrode, and a first fixing region in which the electrode and the intermediate member are fixed and a second fixing region in which the terminal and the intermediate member are fixed are shifted from each other in the longitudinal direction.

7 Claims, 12 Drawing Sheets

IMAGE HEATING APPARATUS AND IMAGE FORMING APPARATUS HAVING AN INTERMEDIATE MEMBER FIXED TO A TERMINAL AND FIXED TO AN ELECTRODE AT REGIONS SHIFTED FROM EACH OTHER

BACKGROUND OF THE INVENTION

Field of the Invention

The present invention relates to an image forming apparatus based on an electrophotographic or electrostatic recording method such as a printer, a copier, and a multifunction device having the functions of these devices. The present invention also relates to an image heating apparatus such as a fixing apparatus installed in an image forming apparatus or a gloss applying device which improves the glossiness of a toner image by reheating the toner image fixed to a recording material.

Description of the Related Art

A film-heating image heating apparatus has been known as an image heating apparatus such as a fixing apparatus installed in an electrophotographic image forming apparatus. The image heating apparatus includes an endless belt-shaped heat-resistant film (also referred to as a fixing film), a heater in contact with the inner surface of the film, a heater holder for holding the heater, and a pressurizing roller for forming a nip part with the heater through the film. In the image heating apparatus, the toner image is fixed on a recording material as the recording material bearing the toner image is heated in the nip part and transported. Since the film heating image heating apparatus has a low heat capacity, power can be saved and the wait time may be reduced (which enables a quick start).

The substrate of a terminal heater is provided with a heat-generating element and an electrode electrically connected to the heat-generating element. A connector for supplying power is connected to the electrode. Japanese Patent Application Publication No. H04-351877 proposes a technique for improving the reliability of a power feeding part (the connection part between an electrode and a terminal) in a high temperature environment by ultrasonically bonding the electrode on the substrate and the terminal of the connector.

Patent Literature 1: Japanese Patent Application Publication No. H04-351877

SUMMARY OF THE INVENTION

In the process of using the image heating apparatus, thermal stress is repeatedly generated at the feeding part as the temperature increases and decreases. More specifically, when the substrate of the heater thermally expands according to the linear expansion coefficient of the material of the substrate, the electrode also thermally expands to a similar extent. The terminals also thermally expand according to the linear expansion coefficients of the materials. In the apparatus disclosed in Japanese Patent Application Publication No. H04-351877, when the linear expansion coefficients of the substrate and the terminal are significantly different, large thermal stress can be generated in the ultrasonically bonded power feeding part because of the difference in the thermal expansion amounts of these elements. When the thermal stress is generated repeatedly, the terminals may be disconnected from the substrate. In addition, when the substrate is made of a ceramic which is a so-called brittle material and the terminal is a metal, the line expansion coefficient of the metal is greater than the line expansion coefficient of the ceramic, and therefore force is applied in the direction which causes the ceramic to be pulled during the thermal expansion of both the substrate and the terminal. As a result, fatigue may accumulate at the ceramic, which can shorten the useful life of the substrate.

With the foregoing in view, it is an object of the present invention to reduce thermal stress which is repeatedly generated at the power feeding part and improve the reliability of the apparatus.

The present application provides an image heating apparatus, comprising:

a heater that includes a substrate having a longitudinal direction which is a direction orthogonal to a direction in which a recording material is transported, a heat-generating element provided in the substrate, and an electrode configured to feed electric power to the heat-generating element; and a terminal that is electrically connected to the electrode, wherein, the image heating apparatus heats an image formed on the recording material by heat from the heater, a conductive intermediate member including at least one layer is provided between the terminal and the electrode, the electrode and the intermediate member are fixed with each other, the terminal and the intermediate member are fixed with each other, and a first fixing region in which the electrode and the intermediate member are fixed and a second fixing region in which the terminal and the intermediate member are fixed are shifted from each other in the longitudinal direction.

An image heating apparatus according to the present invention can operate with reduced thermal stress caused by the difference between the linear expansion coefficients of terminals using intermediate members and allows the reliability of the elements to be improved.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. Note that the dimensions, materials, shapes, and relative positional arrangements of the components in the following description of the embodiments should be modified as appropriate according to the configuration of a device to which the present invention is applied or various conditions under which the present invention is applied, and therefore the following embodiments are not intended to limit the scope of the present invention.

First Embodiment

Figure 2:
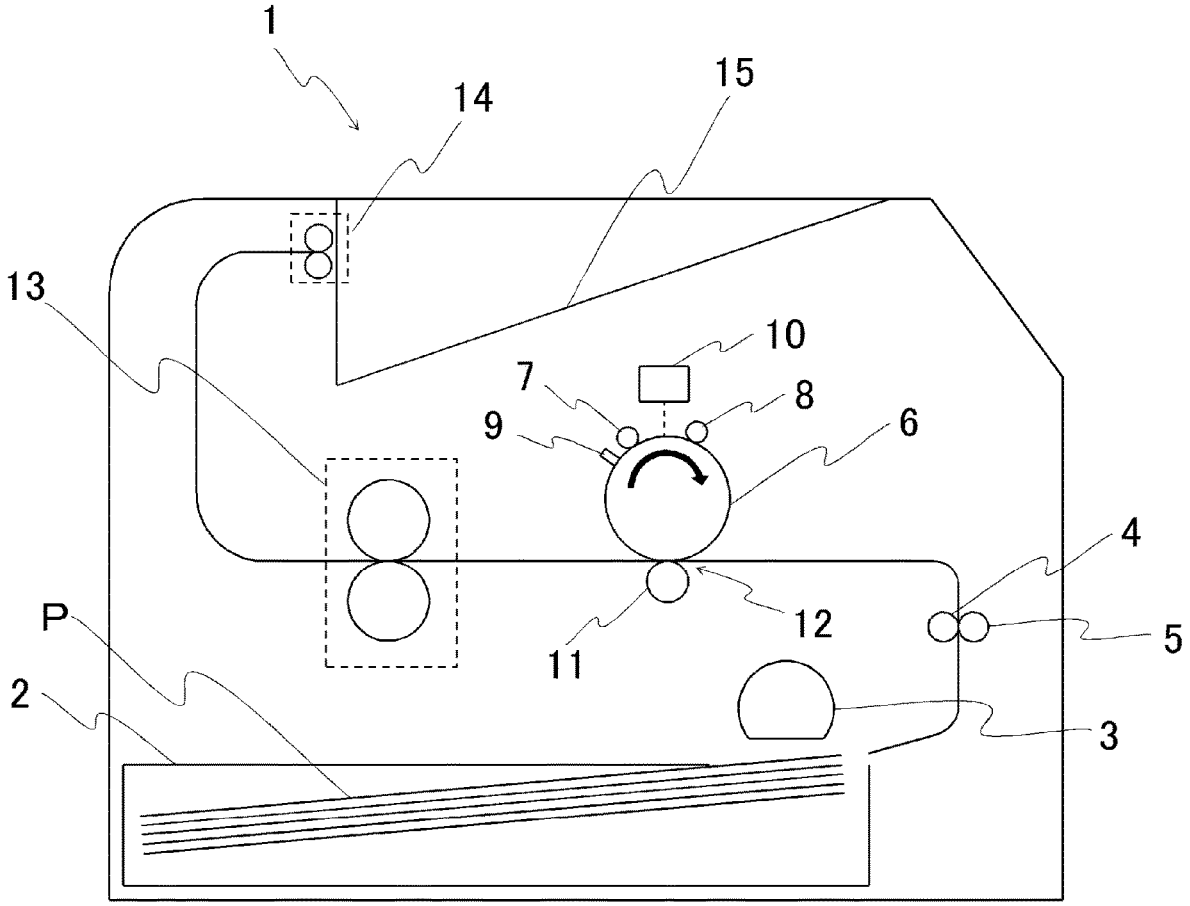
FIG. 2 shows a general structure of an image forming apparatus according to the first embodiment.

Hereinafter, an electrophotographic image forming apparatus (hereinafter as an image forming apparatus) including a fixing apparatus according to a first embodiment of the present invention will be described. FIG. 2 is a schematic sectional view of an exemplary image forming apparatus 1 according to the first embodiment.

1. General Structure of Image Forming Apparatus

The general structure of the image forming apparatus according to the embodiment will be described with reference to FIG. 2. The image forming apparatus 1 according to the embodiment is a laser beam printer.

The image forming apparatus 1 includes a recording material feeding unit and an image forming unit. The recording material feeding unit includes a cassette 2 and a paper feeding roller 3. Recording materials P loaded in the cassette 2 are picked up on a one-by-one basis from the uppermost recording material P by the paper feeding roller 3 and is sent to a nip part formed by a resist roller 4 and a roller 5. The posture of the recording material P is adjusted by the resist roller 4 and the roller 5 and is then sent to the image forming unit.

The image forming unit includes a drum-shaped electrophotographic photosensitive member (hereinafter referred to as a photosensitive drum) 6 as an image bearing member, a charger 7 which charges the photosensitive drum 6, a developer 8 which develops a latent image on the photosensitive drum 6 with toner, and a cleaner 9 used to remove residual toner on the photosensitive drum 6. The photosensitive drum 6 is driven to rotate in the direction indicated by the arrow in the figure. The charger 7 uniformly charges the circumferential surface of the photosensitive drum 6. A laser scanner 10 as an exposure unit is provided above the image forming unit (in the upper part of the paper surface) to form an electrostatic latent image on the photosensitive drum 6 by irradiating the charged photosensitive drum 6 with a laser beam on the basis of image information. The electrostatic latent image is developed as a toner image by the developer 8. The developed toner image is transferred to the recording material P by a transfer unit 12 formed by a transfer roller 11 and the photosensitive drum 6.

The recording material P having the transferred toner image thereon is transported to the fixing apparatus (the image heating apparatus) 13 as a fixing unit (an image heating unit). The toner image on the recording material P is heated and fixed on the recording material P by the fixing apparatus 13. The recording material P which has passed through the fixing apparatus 13 is discharged to a recording material loading unit 15 in the upper part of the image forming apparatus 1 by a pair of discharge rollers 14.

2. Fixing Apparatus

Now, the fixing apparatus 13 according to the embodiment will be described.

Figure 3:
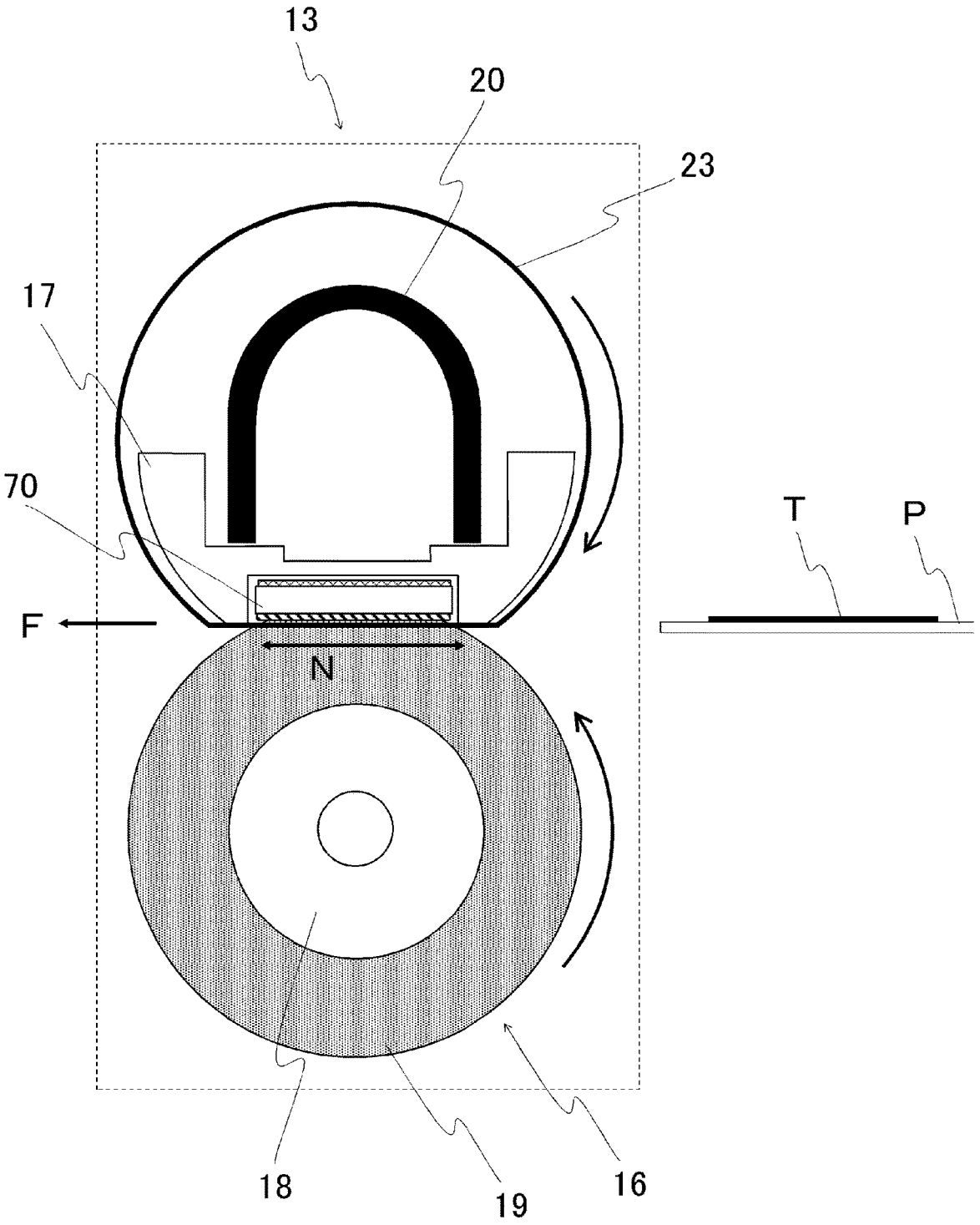
FIG. 3 is a sectional view of a fixing apparatus according to the first embodiment taken in the direction for transporting a recording material.

FIG. 3 is a sectional view of the fixing apparatus 13. The fixing apparatus 13 includes a tubular heating film 23 and a pressurizing roller 16. In this apparatus, the pressurizing roller 16 is rotated by the motive power of a motor (not illustrated), and the heating film 23 is rotated by the transporting force of the pressurizing roller 16. The fixing apparatus 13 includes a heater 70 as a heating member, a heater holder 17 as a holding member which holds the heater 70, and a pressurizing stay 20 which reinforces the heater holder 17. The pressurizing roller 16 is a pressurizing member including a core shaft part 18 and a heat-resistant elastic layer 19. The heater holder 17, the heater 70, and the pressurizing stay 20 are provided in the inner space of the heating film 23. The heater holder 17 is biased toward the pressurizing roller 16 for example by a spring (not illustrated) through the pressurizing stay 20. As the pressurizing roller 16 abuts against the heating film 23, a fixing nip part N for transporting the recording material P is formed between the heating film 23 and the pressurizing roller 16. The heater 70 is in contact with the inner surface of the heating film 23, and therefore when the pressurizing roller 16 rotates, the heating film 23 rotates while the inner surface of the heating film 23 slides on the heater 70.

The recording material P bearing the toner image T thereon is transported by the fixing nip part N. In the transporting process, the heat from the heating film 23 heated by the heater 70 and the pressure of the fixing nip part N are applied to the recording material P, and the toner image T is fixed on the recording material P.

3. Heater and Heater Holder

Figure 4:
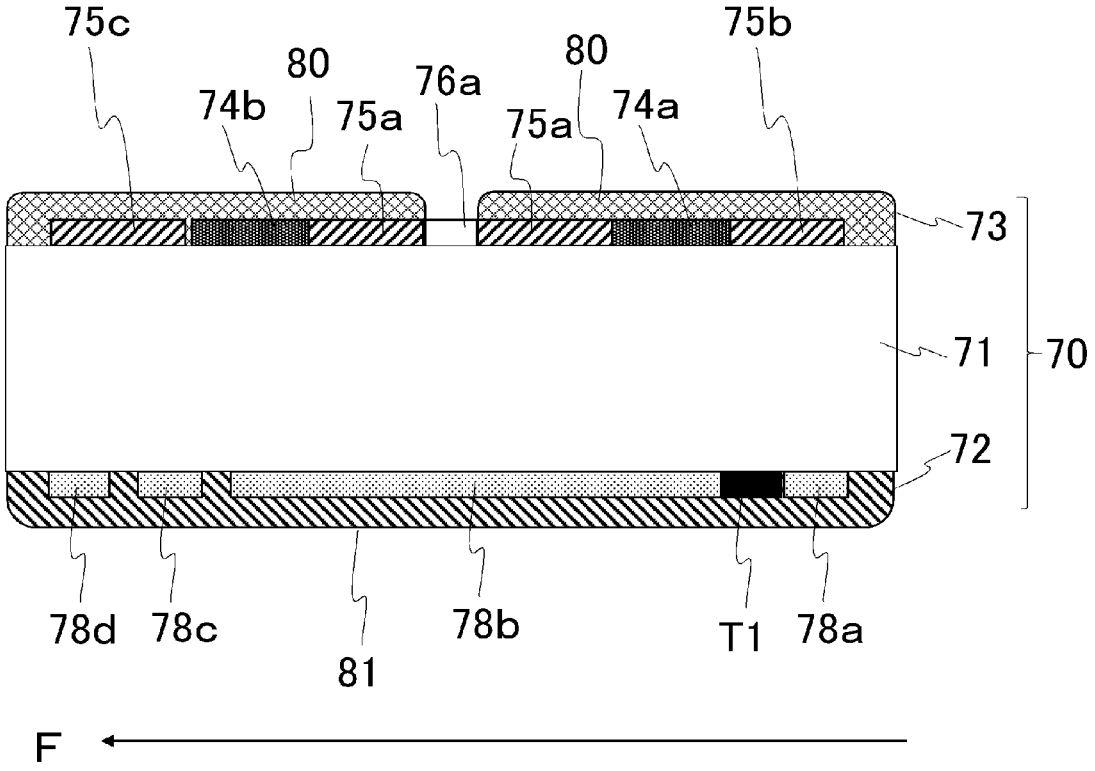
FIG. 4 is a central sectional view of a heater according to the first embodiment.
Figure 5A:
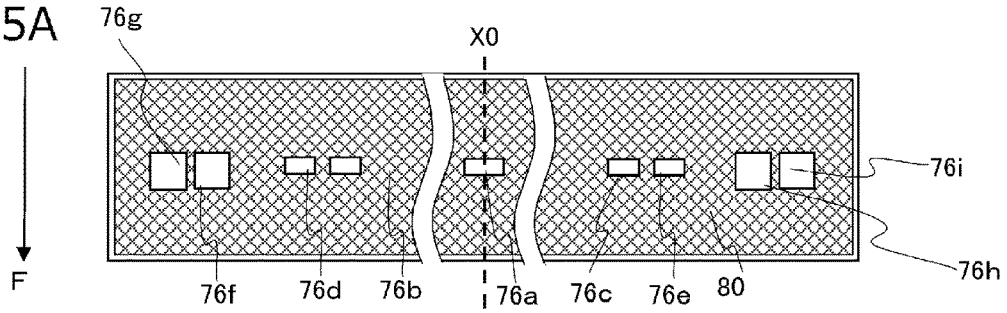
FIGS. 5A to 5E show the structure of the heater and a heater holder according to the first embodiment.
Figure 5B:
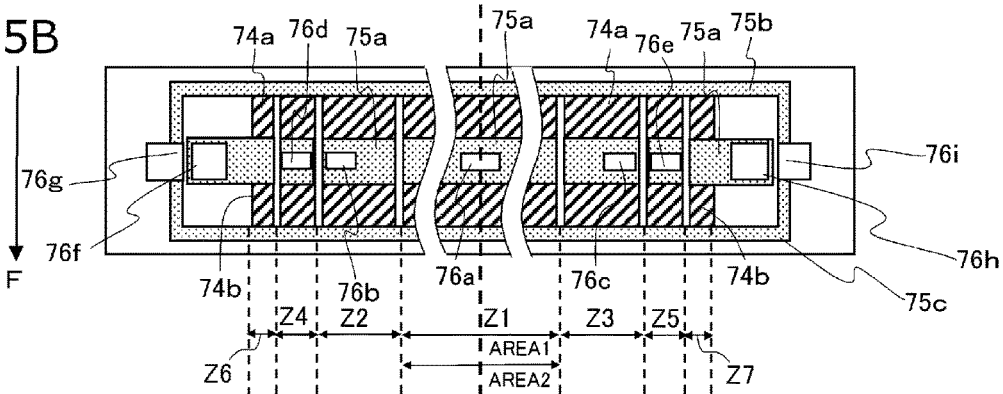
Figure 5C:
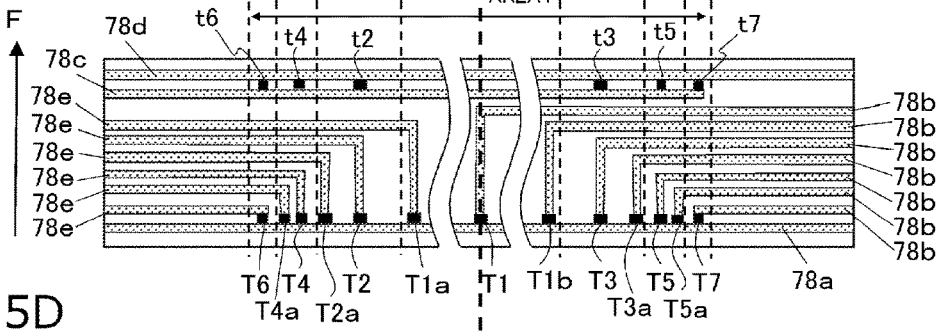
Figure 5D:
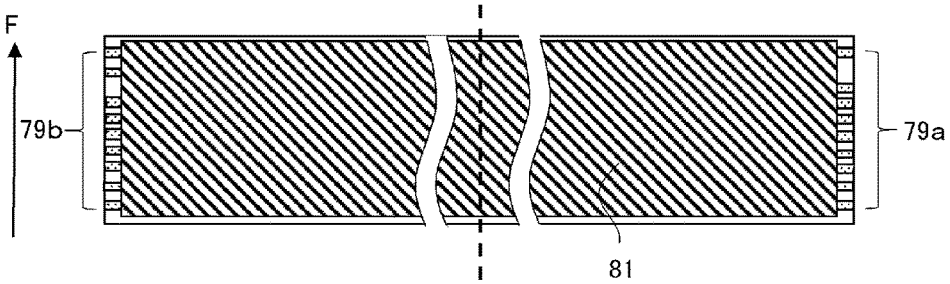

Now, the heater 70 and the heater holder 17 will be described. FIG. 4 is a sectional view of the heater 70 in the center of the heater 70 in the longitudinal direction. FIGS. 5A to 5E are plan views illustrating the structure of the heater 70 and the heater holder 17. FIG. 4 is a sectional view of the heater 70 when the heater 70 is taken along a dotted line representing a transporting reference position X0 in FIGS. 5A to 5E. FIGS. 5A and 5B are views of the heater 70 as viewed from a back surface layer 73. FIG. 5A is a view of the heater 70 as viewed from the top of a protection glass 80, and FIG. 5B is a view of the heater 70 in a state where the protection glass 80 is detached. FIGS. 5C and 5D are views of the heater 70 as viewed from a sliding surface layer 72. FIG. 5D is a view of the heater 70 as viewed from the top of a protection glass 81, and FIG. 5C is a view showing the heater 70 in a state where the protection glass 81 is detached. In FIGS. 5A to 5E, the arrow F on the left of the figures indicates the direction in which the recording material P is transported.

As illustrated in FIG. 4, the heater 70 has a layered structure inducing the sliding surface layer 72, the substrate 71, and the back surface layer 73. Here, the sliding surface of the heater 70 is a surface in contact with the inner surface of the heating film 23. In the nip part N, the inner surface of the heating film 23 contacts the heater 70, more specifically the sliding surface of the heater 70, and the outer surface of the heating film 23 contacts the pressurizing roller 16. The heating film 23 slides while the film is held between the sliding surface of the heater 70 and the pressurizing roller 16. The substrate 71 is configured so that the direction orthogonal to the direction for transporting the recording material P in the nip part N is the longitudinal direction of the substrate 71.

In FIG. 4, a thermistor T1 as a temperature sensing unit and conductors 78*a* to 78*d* are provided in the sliding surface layer 72. Heat-generating elements 74*a* and 74*b*, the conductors 75*a* to 75*c*, and the power supply electrodes 76*a* are provided in the back surface layer 73. In the back surface layer 73, the heat-generating element 74*a* is provided upstream in the direction for transporting the recording material P, and the heat-generating element 74*b* is provided downstream of the transporting direction. The conductors 75*a* and 75*b* are disposed at a position to sandwich the heat-generating element 74*a* therebetween, and the conductors 75*a* and 75*c* are similarly disposed a at a position to sandwich the heat-generating element 74*b*.

When power is supplied to the heat-generating element 74*a* through the conductors 75*a* and 75*b*, the heat-generating element 74*a* generates heat. Similarly, when power is supplied to the heat-generating element 74*b* through the conductors 75*a* and 75*c*, the heat-generating element 74*b* generates heat. The protection glass 80 is provided to cover the heat-generating elements 74*a* and 74*b* and the conductors 75*a* to 75*c* and to expose the electrode 76*a*.

As illustrated in FIG. 5B, seven heat-generating blocks Z1 to Z7 are provided in the back surface layer 73 of the heater 70. The heat-generating blocks each include a conductor 75*b* upstream in the direction for transporting the recording material P, the conductor 75*c* downstream in the transporting direction, and the conductor 75*a* sandwiched between the conductors 75*b* and 75*c*. The heat-generating blocks each include the heat-generating element 74*a* upstream in the direction for transporting the recording material P and the heat-generating element 74*b* downstream in the transporting direction. The electrodes 76*a* to 76*e* are electrically connected to the conductor 75*a* in each of the heat-generating blocks.

As illustrated in FIG. 5A, the protection glass 80 is provided on the heater 70 excluding the positions which overlap the electrodes 76*a* to 76*i*. Therefore, the power supply terminals (which will be described) extended from the backside of the heater 70 can be bonded to the electrodes 76*a* to 76*i*. Note that in the heater 70 according to the embodiment, the heat-generating blocks Z2 and Z3 are driven by a common switch (such as a triac) to always generate heat simultaneously. The heat-generating blocks Z4 and Z5 are also driven by a common switch to always generate heat simultaneously. The heat-generating blocks Z6 and Z7 are also driven by a common switch to always generate heat simultaneously. Only the heat-generating block Z1 is driven independently. In this way, the heat-generating blocks may be supplied with power independently through the terminals and electrodes, and this allows heat generation of the heat-generating blocks to be independently controlled. In this way, the multiple heat-generating blocks are provided, so that four kinds of heat generation distributions can be formed as illustrated by AREA1 to AREA4. According to the embodiment, AREA1 is provided for an A5 sheet, AREA2 for a B5 sheet, AREA3 for an A4 sheet, and AREA4 for a letter sheet.

Since the seven heat-generating blocks are controlled independently, a heat-generating block for supplying power can be selected according to the size of the recording material P, so that there is no excess heating caused in the area which the recording material P does not pass. Note that the number of heat-generating blocks and the widths of the heat-generating blocks in a direction orthogonal to the direction for transporting the recording material P are not limited to those described in conjunction with FIGS. 5A to 5E. According to the embodiment, an electrode group including electrodes 76*g* and 76*f* is formed at the end of the heater 70 on the left in the figure, and an electrode group including electrodes 76*h* and 76*i* is formed at the end of the heater 70 on the right in the figure. In the longitudinal direction of the heater 70, the electrodes 76*a* to 76*e* are provided within the range of the nip part N, while the electrodes 76*f* to 76*i* are provided outside the range of the nip part N.

As illustrated in FIG. 5C, the sliding surface layer 72 of the heater 70 is provided with thermistors T1 to T7 and thermistors T1*a*, T1*b*, T2*a*, T3*a*, T4*a*, T5*a*, and t2 to t7 configured to detect the temperatures of the heat-generating blocks of the heater 70. The thermistors T1 to T7 are used mainly to control the temperatures of the heat-generating blocks. The thermistors T1 to T7 will be hereinafter referred to as temperature controlling thermistors T1 to T7.

The thermistors T1*a*, T1*b*, T2*a*, T3*a*, T4*a*, and T5*a* are thermistors configured to detect the temperatures at the ends of the heat-generating blocks. The thermistors T1*a*, T1*b*, T2*a*, T3*a*, T4*a*, and T5*a* will be hereinafter referred to as end thermistors T1*a*, T1*b*, T2*a*, T3*a*, T4*a*, and T5*a*. The end thermistors T1*a*, T1*b*, T2*a*, T3*a*, T4*a*, and T5*a* are each provided in a position closer to an end in a corresponding one of the heat-generating blocks with respect to a transporting reference position X0 except for the heat-generating blocks Z6 and Z7 at opposed ends having a width smaller than those of the other heat-generating blocks. The heat-generating areas in the heat-generating blocks Z6 and Z7 each have a small width, and therefore no end thermistor is provided for these blocks.

The thermistor t2 to t7 are provided as auxiliary elements which can be used to detect the temperatures of the heat-generating blocks if the temperature control thermistors or end thermistors fail. Hereinafter, the thermistor t2 to t7 will also be referred to as a sub-thermistor. The sub-thermistors t2 to t7 are provided in the longitudinal direction of the heater 70 in positions corresponding to the temperature control thermistors T2 to T7. The thermistors T1 to T7 and the end thermistors T1*a*, T1*b*, T2*a*, T3*a*, Ta, T4*a*, and T5*a* each have one electrical end connected to the common conductor 78*a* and the other end connected to the conductor 78*b* or 78*e*. The sub-thermistors t2 to t7 each have one end connected to the common conductor 78*c* and the other end connected to the common conductor 78*d*. The conductors 78*a* to 78*d* extend to the opposed ends of the heater 70 in the longitudinal direction of the heater 70.

As illustrated in FIG. 5D, the thermistors and the conductors 78*a* to 78*d* are covered with the protection glass 81 except at the opposed ends of conductors 78*a* to 78*d* in the longitudinal direction of heater 70. The parts of the conductors 78*a* to 78*d* which are not covered with the protection glass 81 and are exposed form electrode groups 79*a* and 79*b* for the thermistors.

In this way, using the heater 70 according to the embodiment, the heat-generating blocks Z1 to Z7 can be controlled independently while the temperatures of the heat-generating blocks are detected. Therefore, a fixing apparatus capable of forming a heat generation distribution suitable for the size of a recording material P transported to the fixing nip part N can be provided. Although the sub-thermistors are provided in the description of the embodiment, the heater 70 may be configured without the sub-thermistors. The presence of the sub-thermistors allows more sophisticated and precise control to be achieved.

Figure 5E:
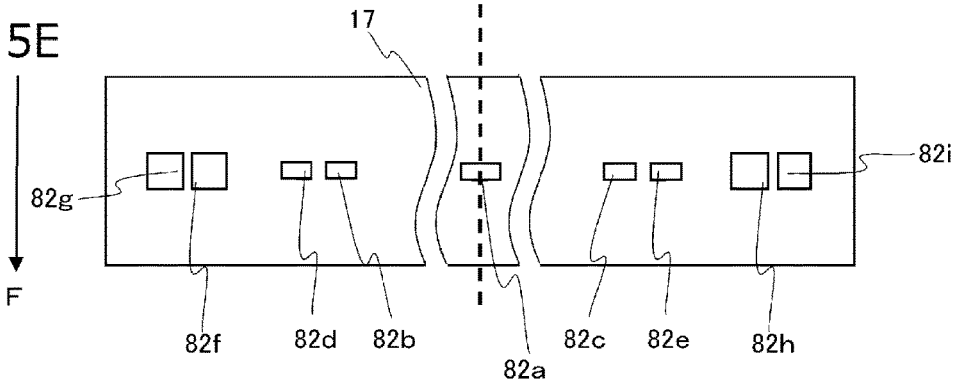

As illustrated in FIG. 5E, the heater holder 17 has openings 82*a* to 82*i* corresponding to the electrodes 76*a* to 76*i*. The space between the pressurizing stay 20 and the heater holder 17 is provided with terminals to be electrically connected to the electrodes 76*a* to 76*e*. Connectors 300 are connected to the electrodes 76*f* to 76*i* disposed at the longitudinal ends of the heater 70. A springy terminal 302 is provided in the housing 301 of each of the connectors 300, and the terminals 302 contact the electrodes 76*f* to 76*i* using the springiness.

4. Power Feeding Arrangement

Figure 6A:
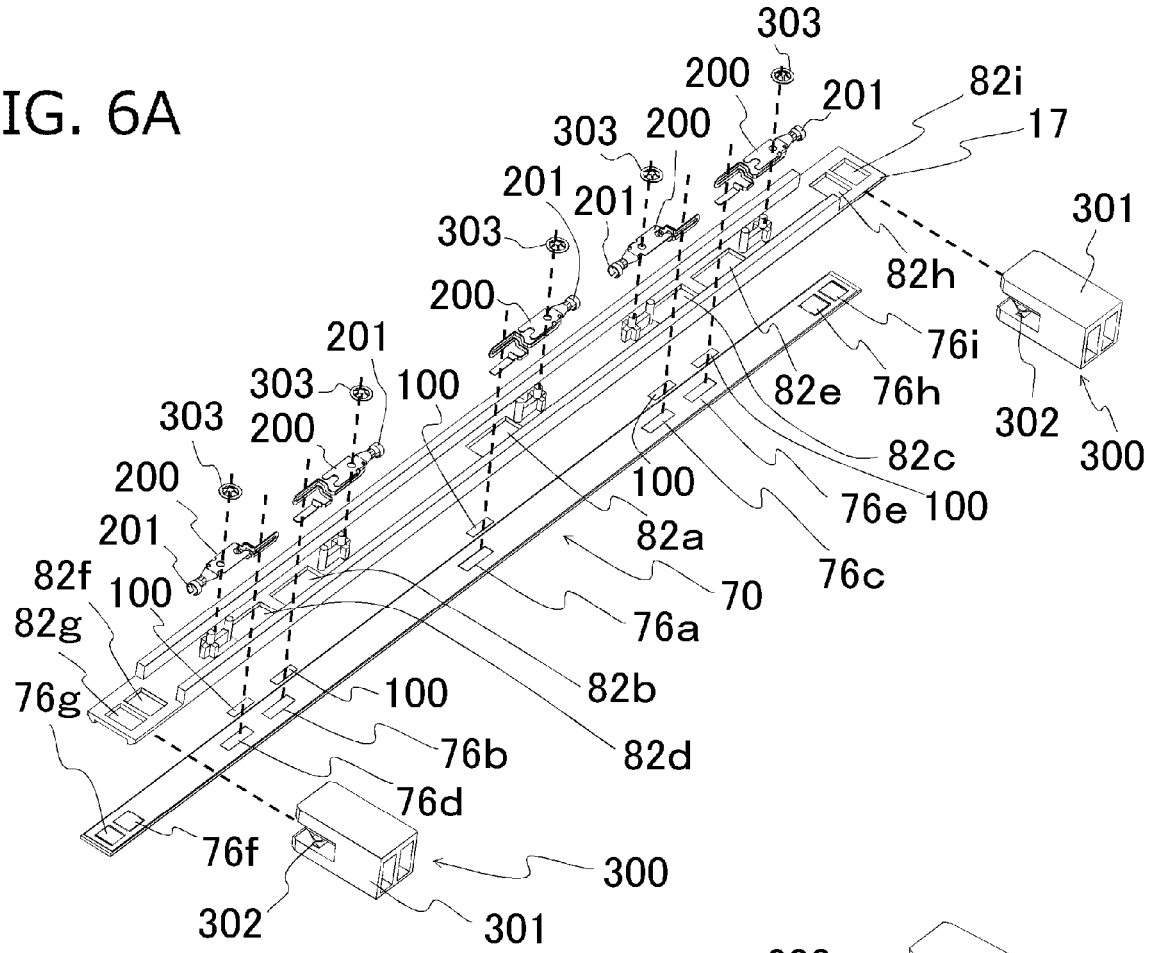
FIGS. 6A and 6B are general views of the power feeding arrangement according to the first embodiment.
Figure 6B:
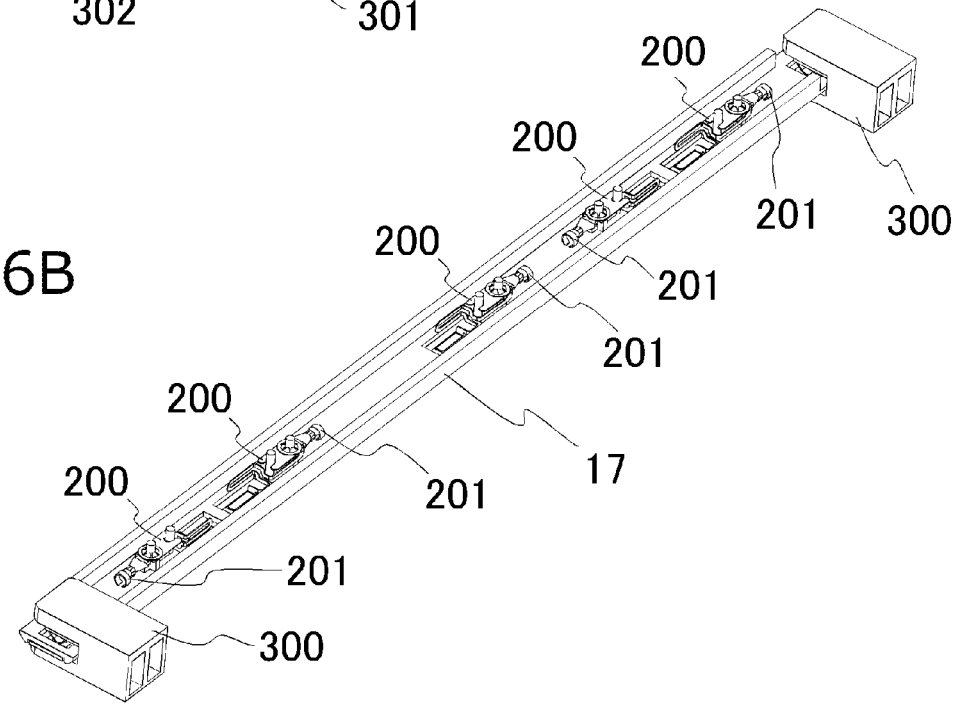

FIGS. 6A and 6B are general views illustrating the relation among the heater 70, the heater holder 17, and the power supply terminal 200. FIG. 1 is a perspective view of the terminal 200.

As illustrated in FIG. 6A, according to the embodiment, two types of power feeding arrangements are used as the power feeding arrangements for the heat-generating blocks Z1 to Z7 of the heater 70. In the first type of power feeding arrangement, a single-layered, flat plate-like intermediate member 100 having conductivity and terminals 200 are placed on each other in a sequence to overlap the electrodes 76*a* to 76*e*. The electrodes 76*a* to 76*e* and the intermediate members 100, and the intermediate members 100 and the terminals 200 are electrically bonded to each other. A clamping part 201 is provided at each of the terminals 200 to caulk a bundle wire (cable) (which is not illustrated) electrically connected to the terminal 200.

In the second type of power feeding arrangement, the electrodes 76*f* to 76*i* and the power supply (not illustrated) are connected through the connectors 300 as described above. The connector 300 is placed on the heater holder 17 in the width-wise direction of the heater 70 while the heater holder holds the heater 70. The terminal 302 provided in the housing 301 of the connector 300 then elastically deforms according to the thickness of the heater 70. The reaction force caused by the deformation of the terminal 302 provides an electrical contact between the connector 300 and the electrodes 75*f* to 76*i*. According to the embodiment, the terminal 302 generate pressurizing force to be applied on the connector 300, but a spacer may be placed on the side of the sliding surface layer 72 depending on the thickness of the heater 70. The presence of the spacer allows the pressurizing force applied by the terminal 302 on the connector 300 to be more uniform and the electrical connection between the connector 300 and the electrodes 75*f* to 76*i* to be more stable.

FIG. 6B shows the power feeding arrangement in FIG. 6A in an assembled state. As described above, the electrodes 76*a* to 76*e* are electrically connected to the intermediate members 100 and the terminals 200 in the positions of the openings 82*a* to 82*e* provided in the heater holder 17. The directions of the multiple terminals 200 are not entirely the same. The terminals 200 are arranged in different directions, so that the bundle wire (not illustrated) connected to the terminals 200 can be separated to the opposed ends of the heater holder 17 in the longitudinal direction. This provides an advantageous effect in that the sectional area of the pressurizing stay 20 and the heater holder 17 can be reduced. The heating film 23 can also have a reduced diameter. The connector 300 as another power feeding arrangement can also provide an advantageous effect in that the electrical contact can be made between the terminals 302 and the electrodes 76*f* to 76*i* through the openings 82*f* to 82*i*.

Figure 1A:
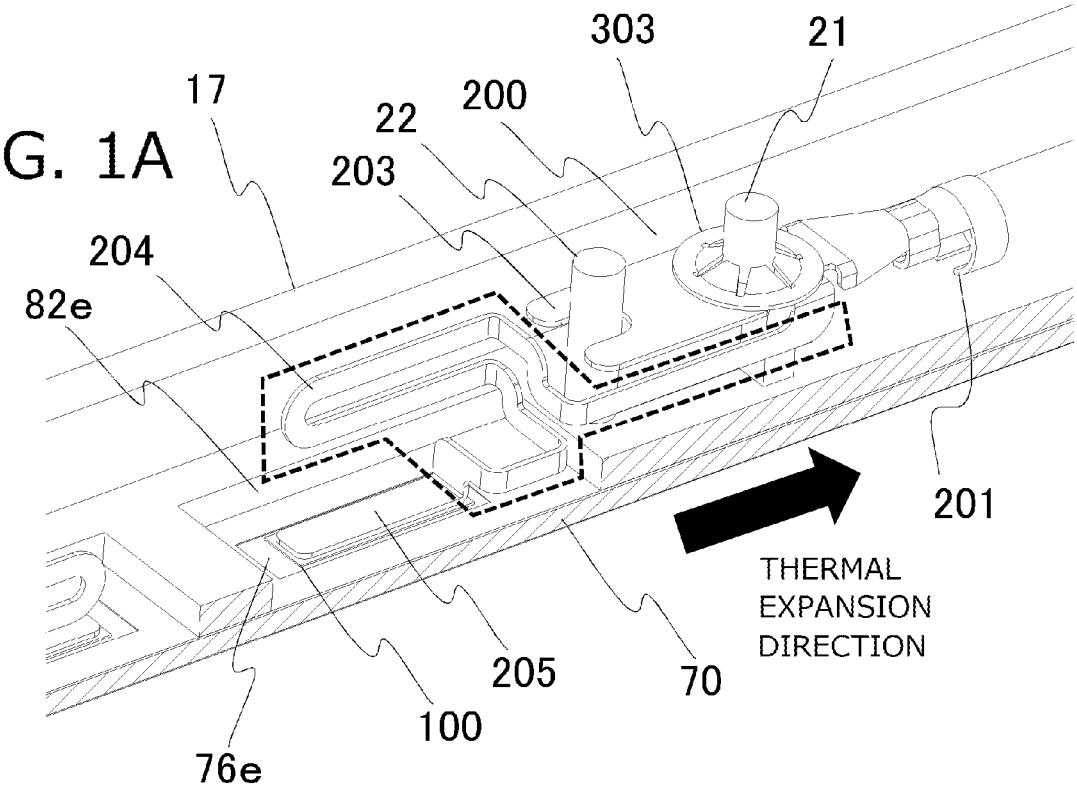
FIGS. 1A and 1B are perspective sectional views of a power feeding arrangement according to a first embodiment of the present invention taken in the longitudinal direction.

Now, the power feeding arrangement provided in the heater 70 will be described in detail with reference to FIG. 1A. FIG. 1A shows the state in which the electrode 76*e* illustrated in FIG. 6 is provided in the heater 70. Note that the electrodes 76*a* to 76*d* are provided in the heater 70 in the same manner as that illustrated in FIG. 1A.

As illustrated in FIG. 1A, the terminal 200 is provided with a positioning part 202 and a rotation stopper 203. The positioning part 202 has a hole through which a positioning boss 21 provided in heater holder 17 is inserted. The rotation stopper 203 has a recess that fits into the rotation stop boss 22 provided in the heater holder 17. As the positioning part 202 is inserted in the positioning boss 21, and the rotation stop boss 22 is fitted to the rotation stopper 203, a push nut 303 is fitted to the positioning boss 21, so that the terminals 200 are fixed to the heater holder 17.

The terminal 200 has a deformation part 204 and a junction part 205. The deformation part 204 absorbs the relative displacement difference in thermal expansion between the heater holder 17 and heater 70. More specifically, the heater holder 17 is made of a heat-resistant resin and the heater 70 is made of ceramic. The linear expansion coefficient of the heat-resistant resin (liquid crystal polymer) is about 10 to $100\times10^{-6}/°$ C., and the linear expansion coefficient of the ceramic is about 0.1 to $10\times10^{-6}/°$ C.

Changes in the deformation part 204 and the junction part 205 in association with the thermal expansion of the heater holder 17 and the heater 70 will be described. First, when the heater 70 generates heat, the temperature of the heater 70 increases before the temperature of the heater holder 17 increases. In other words, the thermal expansion of the heater 70 around the transporting reference position X0 is dominant in the initial stage of heat-generation by the heater 70. As a result, the deformation part 204 hardly moves in the expansion direction, but the junction part 205 of the terminal 200 moves in the direction indicated by the arrow in FIG. 1A (the "thermal expansion direction" in the figure). As a result, the deformation part 204 is in the state as if the part contracts in the longitudinal direction of the heater 70. When the heater 70 further continues to generate heat, the heater holder 17 also has an increased temperature and thermally expands around the transporting reference position X0. Depending on the temperature of the heater holder 17, the displacement of the heater holder 17 caused by the thermal expansion may become greater than the displacement of the heater 70. Therefore, when the displacement of the heater holder 17 caused by the thermal expansion is greater than the displacement of the heater 70 caused by the thermal expansion, the positioning boss 21 for the heater holder 17 is also displaced in the direction indicated by the arrow. In this way, the deformation part 204 is in the state as if the part is stretched in the longitudinal direction of heater 70. In this manner, the deformation part 204 of the terminal 200 absorbs the relative displacement difference in thermal expansion between the heater holder 17 and the heater 70.

The junction part 205 of the terminal 200 is electrically bonded to the intermediate member 100 on a surface-to-face basis. The intermediate member 100 is electrically bonded to the electrode 76*e* of the heater 70 on a surface opposite to the surface bonded to the junction part 205 of the terminal 200. The terminals 200 and the intermediate members 100 are arranged to be kept from contacting the heat-generating elements 74*a* and 74*b* of the heater 70. This prevents the terminals 200 and the intermediate members 100 from taking away the heat from the heat-generating elements 74*a* and 74*b*, and also prevents the occurrence of unevenness in the fixability of the recording material in the longitudinal direction of the heater 70.

Figure 1B:
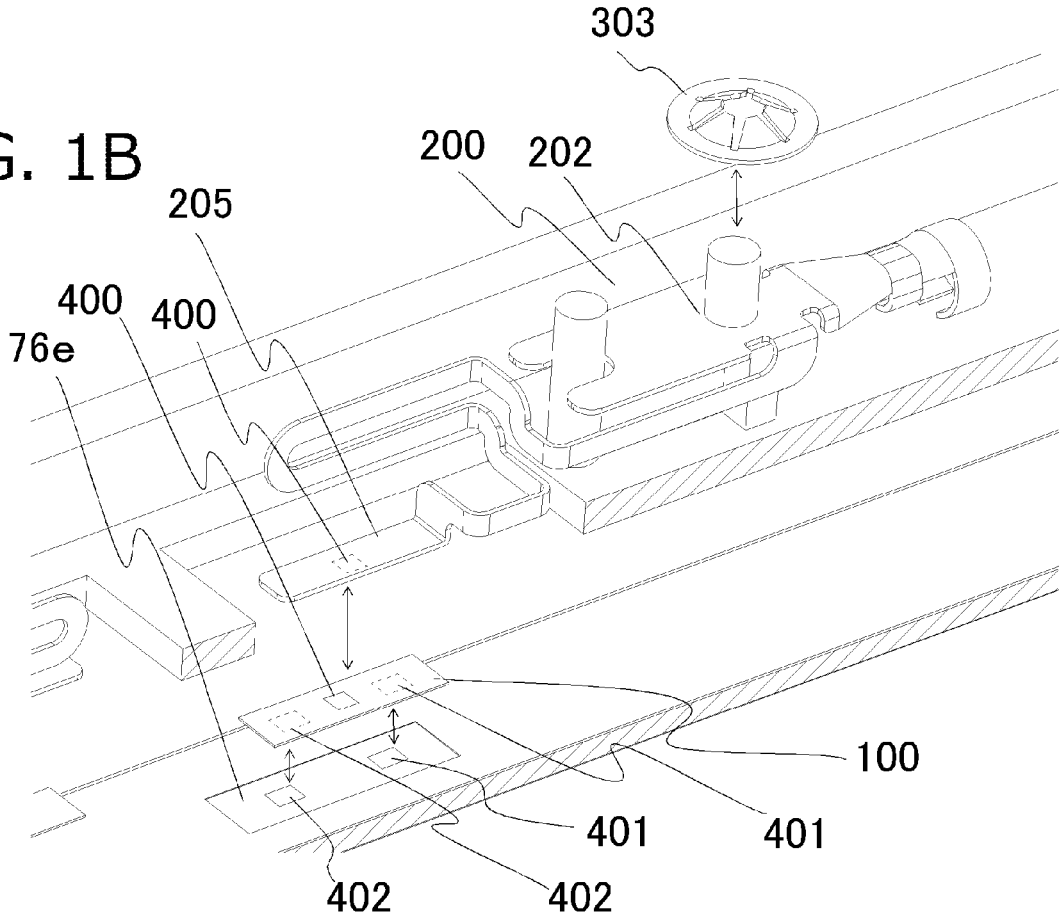

Now, the procedure for bonding various parts of the power feeding arrangement of the heater 70 will be described in detail with reference to FIG. 1B. First, the junction part 205 of the terminal 200 and the intermediate member 100 are electrically bonded by laser bonding in a junction region 400. According to the embodiment, the junction region 400 is a single region. The intermediate member 100 and electrode 76*e* are then electrically bonded by ultrasonic bonding in the junction regions 401 and 402. According to the embodiment, the junction regions 401 and 402 are two regions arranged side by side in the longitudinal direction of the heater 70. Note that the number and the shape of the junctions in the junction regions 400, 401, and 402 may be arbitrary. At least two junction regions 401 and 402 are an example of a first fixed region between the electrode and the intermediate member. The junction region 400 is an example of a second fixed region between a terminal and an intermediate member provided between two first fixed regions.

Figure 7A:
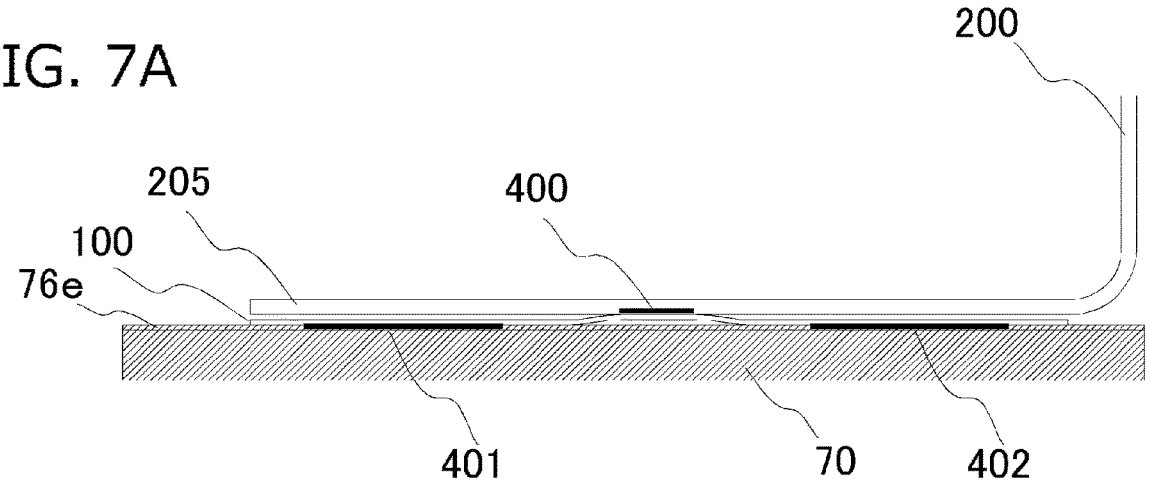
FIGS. 7A to 7C are views showing the deformation of the power feeding arrangement according to the first embodiment caused by thermal expansion.

According to the embodiment, the junction region 400 is provided in the longitudinal direction of the heater 70 so that the region is sandwiched between the junction regions 401 and 402. The arrangement of the junction regions 400, 401, and 402 will be described with reference to FIG. 7A. FIG. 7A shows an example of a deformation state in association with thermal expansion of each part of the power feeding arrangement according to the embodiment. According to the embodiment, the material of the terminal 200 is phosphor bronze for a spring and has a thickness of 0.1 mm to 1 mm. The material of the sheet-like intermediate member 100 is pure copper and has a thickness of 0.01 mm to 0.1 mm. The linear expansion coefficient of phosphor bronze is about $18.2\times10^{-6}/°$ C., while the linear expansion coefficient of pure copper is about $17.7\times10^{-6}/°$ C. The breaking elongation value of phosphor bronze is approximately 10% to 20%, and the breaking elongation value of pure copper is approximately at least 35%. The Young's modulus of the ceramic heater 70 is approximately 280 GPa to 400 GPa, the Young's modulus of the phosphor bronze terminal 200 is approximately 98 GPa, and the Young's modulus of the intermediate member 100 made of pure copper is approximately 118 GPa. The electrode 76*e* of the heater 70 is thin with respect to the thickness of the heater 70 and has physical properties such as a Young's modulus and a linear expansion coefficient which are equivalent to those of the heater 70.

With reference to FIG. 7A, deformation attributable to thermal expansion of each part caused by heat generation by the heater 70 will be described. When the heater 70 generates heat, the heater 70, the terminal 200, and the intermediate member 100 thermally expand to deform as illustrated in FIG. 7A. More specifically, in the junction regions 401 and 402 where the electrodes 76*e* and the intermediate member 100 are bonded, the electrodes 76*e* and the intermediate member 100 deform as the heater 70 deforms. This is because the heater 70 has a greater thickness and a greater Young's modulus than those of the intermediate member 100, so that the intermediate member 100 deforms according to the deformation of the heater 70. Note however that the electrode 76*e* and the intermediate member 100 are not bonded between the junction region 401 and the junction region 402. The intermediate member 100 has a greater linear expansion coefficient than the linear expansion coefficient of the heater 70. Therefore, the extension length of the intermediate member 100 attributable to the thermal expansion of the heater 70 in the longitudinal direction (the left-right direction on the sheet surface of FIG. 7A) is greater than the extension length of the heater 70, which causes the intermediate member 100 to be curved in the junction region 400 as illustrated in FIG. 7A. Note that the material of the intermediate member 100 is selected so that the member may extend without being ruptured even when a distortion is caused by the curve.

In the junction region 400 where the terminal 200 and the intermediate member 100 are bonded, the terminal 200 and the intermediate member 100 deform to have equal amounts of deformation by thermal expansion. This is because the line expansion coefficient of the terminal 200 and the line expansion coefficient of the intermediate member 100 are equivalent. The deformation of the terminal 200 and the intermediate member 100 can reduce the stress attributable to the thermal expansion caused in each of the junction regions 400, 401, and 402. This is because the stresses generated in the junction regions 400, 401, and 402 are independent from each other and do not enhance each other. In particular, since the ceramic heater 70 is made of a so-called brittle material, it is desirable to reduce the stress generated in the junction regions 401 and 402.

Now, advantageous effects which can be provided by arranging the junction regions 400, 401, and 402 as illustrated in FIG. 7A will be described with reference to the examples in FIGS. 7B and 7C. In the example illustrated in FIG. 7B, the junction between the electrode 76*e* and the intermediate member 100 is localized in one junction region 403. A junction region 404 between the terminal 200 and the intermediate member 100 is also provided in a position opposed to the junction region 403 with the intermediate member 100 therebetween.

Figure 7B:
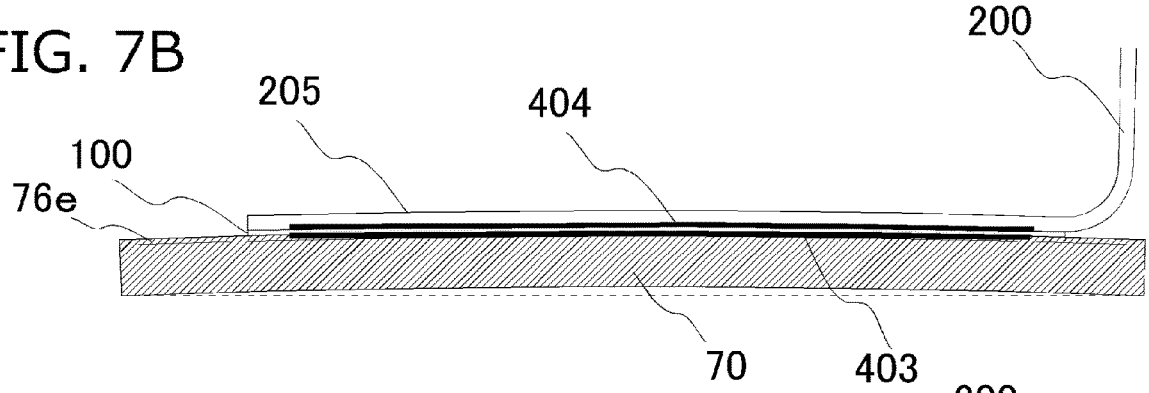

In the example illustrated in FIG. 7B, in the longitudinal direction of the heater, the junction regions 403 and 404 are provided over approximately the entire length of the intermediate member 100. Therefore, when the heater 70 deforms by thermal expansion, not only the intermediate member 100 but also the terminal 200 can easily follow the deformation due to thermal expansion of the heater 70 as compared to the case illustrated in FIG. 7A. Therefore, the stress on the junction region 403 caused by the deformation of the heater 70 attributable to thermal expansion also influences the stress generated in the junction region 404 where the terminal 200 and the intermediate member 100 are bonded. As a result, the stress generated in the junction region 403 where the electrode 76*e* and the intermediate member 100 are bonded is greater than the stress generated in the junction regions 401 and 402 in the example in FIG. 7A.

Figure 7C:
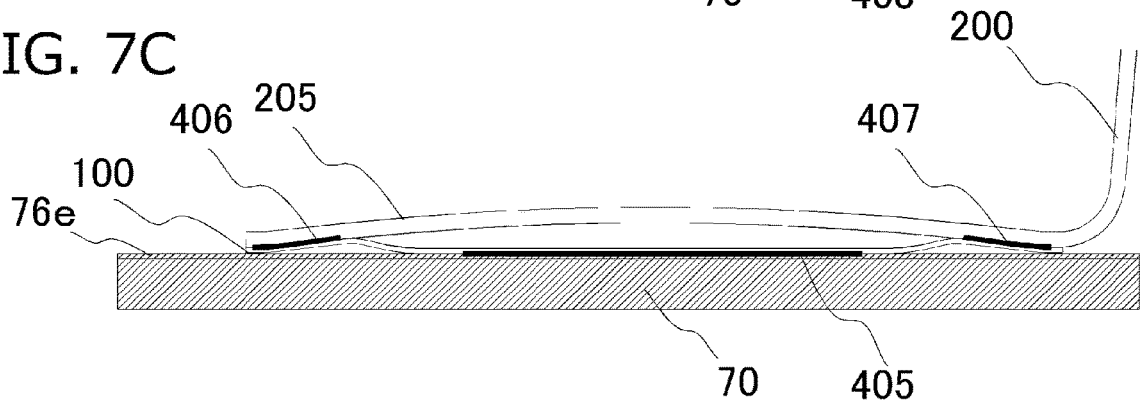

In the example illustrated in FIG. 7C, two junction regions 406 and 407 are provided between the terminal 200 and the intermediate member 100. One junction region 405 where the electrode 76*e* and the intermediate member 100 are bonded is provided between the junction regions 406 and 407 in the longitudinal direction of the heater 70.

In the example illustrated in FIG. 7C, when the heater 70 deforms by thermal expansion, the junction region 405 where the electrode 76*e* and the intermediate member 100 are bonded follows the deformation of the heater 70. In other words, as for the deformation of the intermediate member 100 in the junction region 405, the deformation following the deformation of the heater 70 caused by the thermal expansion is dominant as compared to the deformation of the intermediate member 100 caused by thermal expansion based on the properties of the material. As a result, the amount of deformation of the intermediate member 100 caused by the thermal expansion in the longitudinal direction of the heater 70 is smaller than the amount of deformation of the intermediate member 100 which would be caused by its own thermal expansion. Therefore, the difference between the amount of deformation of the intermediate member 100 caused by the thermal expansion and the amount of deformation of the terminal 200 caused by the thermal expansion should be larger than in the case illustrated in FIG. 7A. As the deformation difference increases, the deformation amount of the terminal 200 is greater than the deformation amount of the intermediate member 100 in the junction regions 406 and 407 as illustrated in FIG. 7C, and therefore the terminal 200 ends up being curved in a direction away from the heater 70. This not only causes stress to be applied the junction regions 406 and 407, but also increases stress applied on the junction region 405 because the intermediate member 100 is pulled to the terminal 200. More specifically, the stress generated in the junction region 405 is influenced not only by the stress resulting from the relative difference in the amount of deformation caused by the thermal expansion between the electrode 76*e* and the intermediate member 100, but also by the stress resulting from the relative difference in the amount of deformation caused by the thermal expansion between the terminal 200 and the intermediate member 100.

In the example illustrated in FIG. 7A, in the power feeding arrangement for the electrodes 76*a* to 76*e* of the heater 70, the intermediate member 100 is provided between the terminal 200 and the electrode 76*e* to reduce the effect of thermal expansion of heater 70. In this way, the thermal stress repeatedly generated in the power feeding arrangement during the operation of the image forming apparatus 1 can be reduced, so that the reliability of the power feeding arrangement can be improved. Therefore, the junction regions provided among the electrode 76*e* and the intermediate member 100 and the terminal 200 are more preferably configured as illustrated in FIG. 7A as compared to the configuration illustrated in FIGS. 7B and 7C.

According to the embodiment, pure copper is used as the material of the intermediate member 100, but any of other materials may be used as the material of the intermediate member 100 if the conductor can absorb the influence of deformation caused by thermal expansion of the heater 70. Therefore, various materials can be used for the intermediate member 100 if the conductor has a Young's modulus less than the Young's modulus of the heater 70 and has an breaking elongation value greater than the breaking elongation value of the heater 70. According to the embodiment, the connecting part between the terminal 200 and the bundle wire is caulked by the clamping part 201, and therefore the thickness of the terminal 200 is desirably set so that the lead wires of the bundle wire are not detached from the clamping part 201. The thickness of the terminal 200 is also desirably set in consideration of the connection strength between the terminal 200 and the bundle wire in the clamping part 201, the assembly of the power feeding arrangement, and the absorption of the relative displacement difference in the thermal expansion between the heater holder 17 and the heater 70. In addition, since the terminal 200 has a certain thickness, it may be expected that the positioning and fixing of various parts in the power feeding arrangement including the terminal 200 in the assembly will be more easily carried out.

5. Manufacturing Method

Figure 8A:
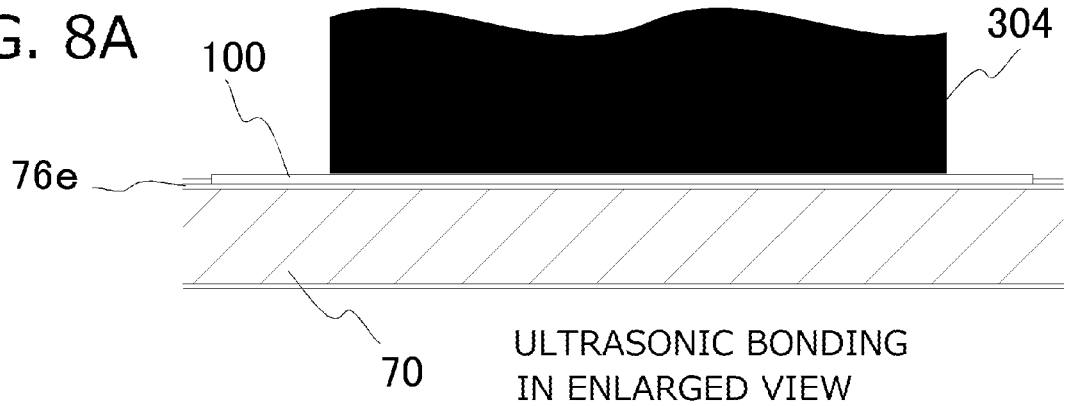
FIGS. 8A to 8C are views for illustrating a method for manufacturing the power feeding arrangement according to the first embodiment.
Figure 8B:
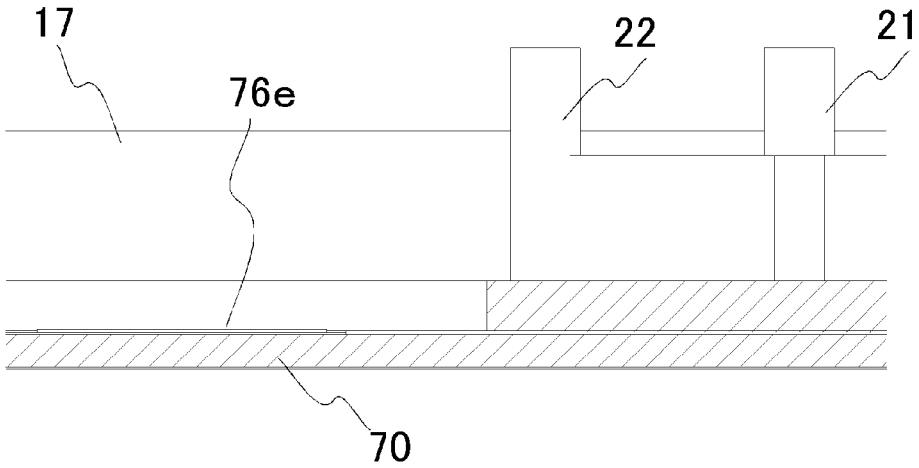
Figure 8C:
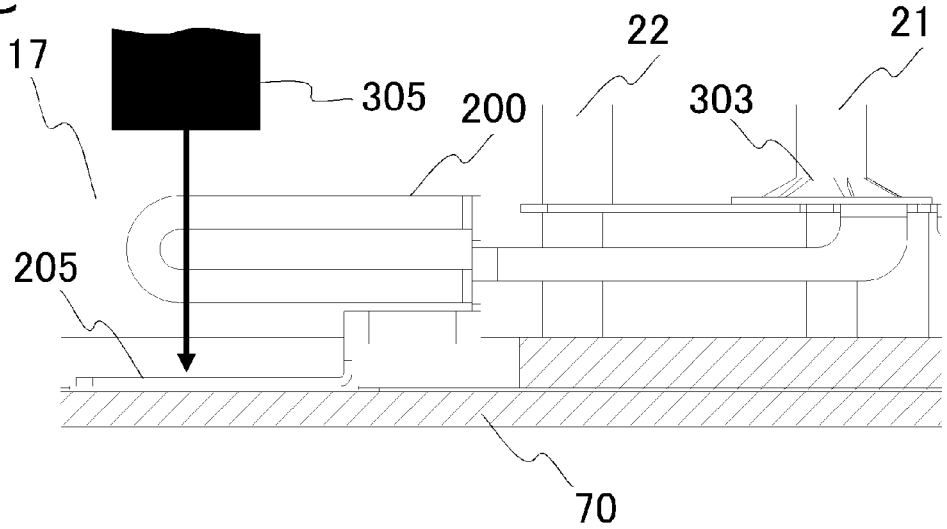

Now, a method for manufacturing a power feeding arrangement according to the embodiment will be described with reference to FIGS. 8A, 8B, and 8C. In the manufacturing method illustrated in FIGS. 8A, 8B, and 8C, the power feeding arrangement for the electrode 76*e* illustrated in FIG. 6A is manufactured. To start with, as illustrated in FIG. 8A, the intermediate member 100 is provided on the electrode 76*e* of the heater 70 so that the member is not in contact with the heat-generating elements 74*a* and 74*b*. A horn 304 for ultrasonic bonding is then pressed against the intermediate member 100 from above. The vibrational energy of a vibrator (not illustrated) is then transmitted to the horn 304, and the electrode 76*e* and the intermediate member 100 are bonded by frictional heat generated at the interface between each other. Then, as illustrated in FIG. 8B, the heater holder 17 is mounted on the heater 70, and the heater holder 17 and the heater 70 are adhesively fixed by a moisture-curable silicon-based adhesive. As illustrated in FIG. 8C, the positioning part 202 of the terminal 200 is placed through the positioning boss 21 of the heater holder 17. The rotation stopper 203 of the terminal 200 is fitted to the rotation stop boss 22 of the heater holder 17. A push nut 303 is fitted to the positioning boss 21, and the terminal 200 is fixed to the heater holder 17. As illustrated in FIG. 8C, a laser beam is irradiated by a laser bonding device 305 on the junction part 205 of terminal 200 from above to bond the junction part 205 of terminal 200 and the intermediate member 100.

In the above-described manufacturing method, the electrode 76*e* and the intermediate member 100 can be bonded by ultrasonic bonding, so that the load on the heater 70 at the time of bonding can be as small as possible. The terminal 200 is positioned by the positioning boss 21 of the heater holder 17 and the rotation stop boss 22. Therefore, the heater holder 17 is provided on the heater 70 before the junction part 205 of the terminal 200 and the intermediate member 100 are bonded. When the ultrasonic bonding is used to bond the junction part 205 and the intermediate member 100, the horn 304 may contact the junction part 205 of the terminal 200. As a result, when vibrational energy is transmitted to the horn 304 as the horn 304 is in contact with the heater holder 17 or the terminal 200, the vibrational energy is transmitted to the heater holder 17 or the terminal 200, and this may damage the heater holder 17 or the terminal 200.

According to the embodiment, the laser bonding device 305 capable of non-contact bonding between the junction part 205 and the intermediate member 100 can be used, so that the bonding can be achieved even in the opening 82*e* provided in a limited space without applying a load to members that are not a bonding target. Meanwhile, in laser bonding, a laser beam may penetrate the junction part 205. However, the intermediate member 100 is provided on the electrode 76*e* of the heater 70. In this way, even when the laser beam passes through the junction part 205, the intermediate member 100 functions as a protection member which protects the heater 70 from the laser beam, so that the load on the heater 70 caused by the laser beam can be reduced.

According to the embodiment, the junction region 400 and the junction regions 401 and 402 are arranged so as not to overlap each other when viewed in a direction orthogonal to the flat surface part of the intermediate member 100. The positional arrangement of the junction regions 400, 401, and 402 is also advantageous in the above-described manufacturing method. More specifically, when the electrode 76*e* and the intermediate member 100 are bonded, a bonding mark is left at the part of the upper surface of the intermediate member 100 opposed to the junction regions 401 and 402. However, in the junction region 400 which does not overlap the junction regions 401 and 402, there is no such process marks on the upper surface of the intermediate member 100. Therefore, the part of the upper surface of the intermediate member 100 to be the junction region 400 is formed as a smooth surface. Therefore, since the bonding between the intermediate member 100 and the terminal 200 can be performed on the smooth surface of the intermediate member 100, so that stable bonding can be achieved in the ultrasonic bonding.

According to the embodiment, ultrasonic bonding and laser bonding are used in the method for manufacturing the power feeding arrangement, but the kind of bonding is not limited to these kinds of bonding. If a bond can be securely formed between two members to be joined, the members may be bonded on a flat surface-to-flat surface basis for example by solid-phase bonding, welding, pressure-welding, brazing, or a conductive adhesive. In particular, the various bonding methods described above are preferred as the method for fixing an electrode and an intermediate member. Meanwhile, an intermediate member and a terminal may be fixed by any of the above bonding methods as well as a connecting method which has members inserted within each other such as pressure fitting, shrinkage fitting, and clamping instead of bonding. In this way, an electrode and an intermediate member are preferably bonded for example by solid-phase bonding, welding, pressure-welding, brazing, or a conductive adhesive while an intermediate member and a terminal may be fixed either by bonding or connecting for example by pressure fitting, shrinkage fitting, or clamping.

According to the embodiment, the junction regions 400, 401, and 402 are arranged so as not to overlap each other in a direction orthogonal to the flat surface part of the intermediate member 100. However, if the regions are displaced from each other in the longitudinal direction of the heater 70 as viewed in a direction orthogonal to the flat surface part of the intermediate member 100, the same advantageous effects as described above can be expected even with some overlapping areas.

In order to achieve stable bonding to the intermediate member 100 and the terminal 200, plating process may be performed on these members. When the members to be joined are plated, the members may have surfaces less oxidized. The plating material used for the plating process may be a material resistant to oxidation such as tin, nickel, and gold.

Second Embodiment

Now, a second embodiment of the present invention will be described. According to the first embodiment, the stress generated at each of the junction regions should be kept from affecting another junction region in order to reduce the stress generated by the deformation of each of the members caused by thermal expansion at each of the junction regions. A power feeding arrangement according to the second embodiment will be described with reference to FIG. 9. Note that in the following description, the same components as those of the first embodiment are denoted by the same reference characters, and a detailed explanation thereof will not be provided.

Figure 9:
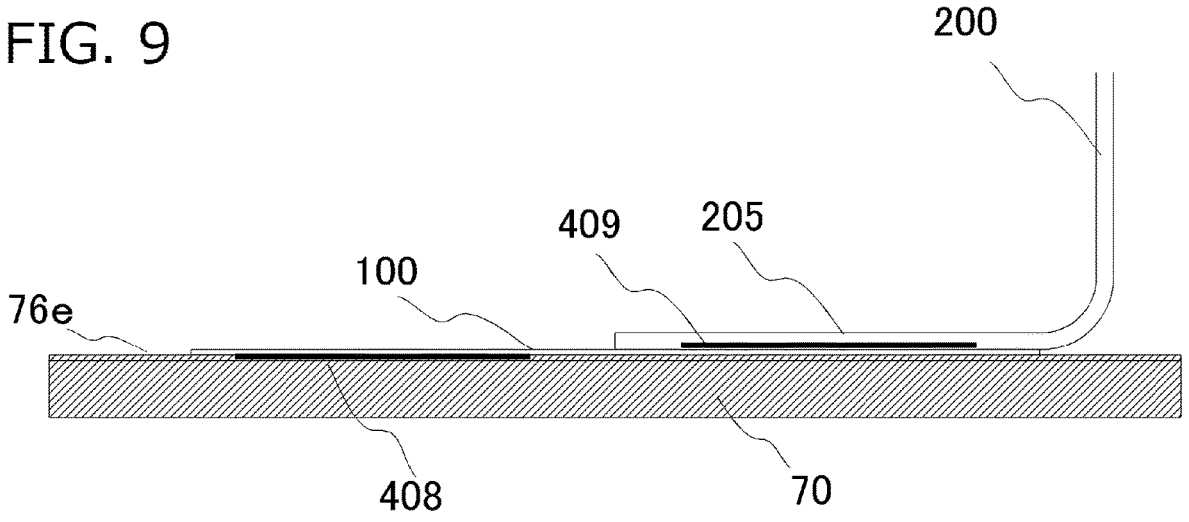
FIG. 9 is a sectional view of a power feeding arrangement according to a second embodiment of the present invention.

FIG. 9 shows a longitudinal section of the heater 70 in the power feeding arrangement according to the embodiment and corresponds to FIGS. 7A, 7B, and 7C. The power feeding arrangement according to the embodiment includes a junction region 408 where the electrode 76*e* and the intermediate member 100 are bonded and a junction region 409 where the terminal 200 and the intermediate member 100 are bonded. Unlike the junction regions 401 and 402 according to the first embodiment, one junction region 408 is provided between the electrode 76*e* and the intermediate member 100. The junction region 408 where the electrode 76*e* and the intermediate member 100 are bonded and the junction region 409 where the terminal 200 and the intermediate member 100 are bonded are arranged so that these regions do not overlap each other when the regions are viewed in a direction orthogonal to the flat surface part of the intermediate member 100. In this way, the degree of freedom of deformation by thermal expansion of the junction regions 408 and 409 is greater than when the junction regions 408 and 409 are arranged to overlap each other. As a result, stress generated in one of the junction regions 408 and 409 can be kept from influencing stress generated in the other region, in other words, the stress enhancement can be reduced.

The difference in the amount of deformation caused by thermal expansion between the heater holder 17 and the heater 70 may curve the intermediate member 100. This is because the influence of the relative difference in the amount of deformation caused by thermal expansion between the heater holder 17 and the heater 70 stretches to the intermediate member 100 before being absorbed as described above by the deformation part 204 of the terminal 200. Therefore, according to the embodiment, the intermediate member 100 is bonded to the electrode 76*e* and the terminal 200 in two junction regions 408 and 409 which do not overlap each other when the regions are viewed in a direction orthogonal to the flat surface part of the intermediate member 100. As a result, it may be expected that the intermediate member 100 is less likely to be curved. In the power feeding arrangement according to the embodiment, materials having small linear expansion coefficients which are approximate to each other are preferably selected as materials for the heater holder 17 and the heater 70.

Note that the power feeding arrangement according to the embodiment is not limited to the power feeding arrangement illustrated in FIG. 9. The arrangement needs only reduce the influence of stress caused by the thermal expansion of one of junction regions on stress generated in other junction regions. Also, according to the embodiment, the junction regions are arranged in the longitudinal direction of the heater 70 in different positions of the intermediate member 100, so that the space of the heater 70 in the longitudinal direction can be effectively utilized.

Third Embodiment

Now, a third embodiment of the present invention will be described. In the following description, the same components as those of the first embodiment are denoted by the same reference characters, and a detailed description thereof will not be provided. The heater 70 according to the third embodiment has the same structure as the first embodiment as illustrated in FIG. 5.

Figure 10:
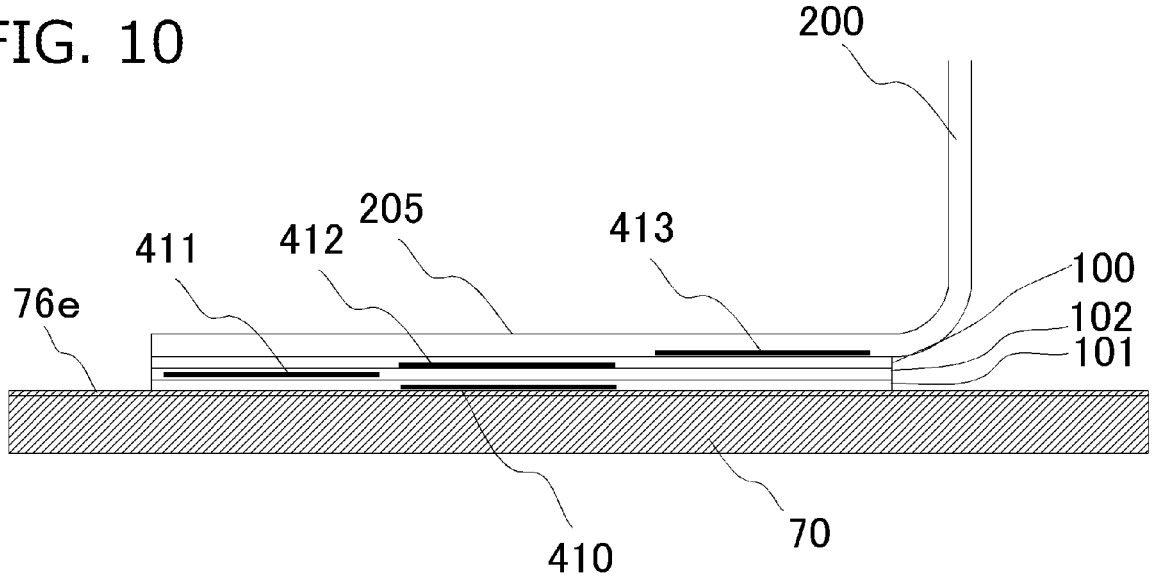
FIG. 10 is a sectional view of a power feeding arrangement according to a third embodiment of the present invention.

FIG. 10 shows a longitudinal section of the heater 70 in the power feeding arrangement according to the embodiment. FIG. 10 shows a section of the power feeding arrangement of the electrode 76*e* in FIG. 6. Note that the power feeding arrangement for the electrodes 76*a* to 76*d* is the same as the power feeding arrangement for the electrode 76*e*. As illustrated in FIG. 10, according to the embodiment, a titanium intermediate member 101 is provided on the electrode 76*e* of the heater 70 and the electrodes 76*e* and the intermediate member 101 are bonded to each other in a junction region 410. The intermediate member 101 is arranged and bonded so that a nickel intermediate member 102, a copper intermediate member 100, and a phosphor bronze terminal 200 are stacked on each other in the mentioned order from below. The junction region where the intermediate member 101 and the intermediate member 102 are bonded is a junction region 411. The junction region where the intermediate member 102 and the intermediate member 100 are bonded is a junction region 412. The junction region where the intermediate member 100 and the terminal 200 are bonded is a junction region 413.

The material of the heater 70 is ceramic which has a linear expansion coefficient of about 0.1 to $10\times10^{-6}$/° C. As for the materials of the intermediate members, titanium has a linear expansion coefficient of about $8.4\times10^{-6}$/° C., nickel has a linear expansion coefficient of about $13.4\times10^{-6}$/° C., pure copper has a linear expansion coefficient of about $17.7\times10^{-6}$/° C., and phosphor bronze a linear expansion coefficient of about $18.2\times10^{-6}$/° C.

Note that the method for bonding the members in the junction regions is the same as that according to the first embodiment and therefore will not be described in detail. According to the embodiment, two junction regions provided with an intermediate member therebetween are arranged not to overlap each other when the regions are viewed in a direction orthogonal to the flat surface part of the intermediate member 100. More specifically, the junction regions 410 and 411, the junction regions 411 and 412, and the junction regions 412 and 413 are positioned not to overlap each other when these regions are viewed in a direction orthogonal to the flat surface part of the intermediate member 100.

Materials for the intermediate members are also selected so that the linear expansion coefficients of the intermediate members 100 and 101 provided between the intermediate member 101 bonded to the electrode 76*e* and the terminal 200 are each within a range determined by the linear expansion coefficients of the intermediate member 100 and the terminal 200. Materials for the intermediate members 100 and 102 are selected so that the linear expansion coefficient varies step by step from the intermediate member 101 to the terminal 200. More specifically, the material for the intermediate member 100 is selected so that the intermediate member 100 has a linear expansion coefficient between the linear expansion coefficients of the intermediate member 101 and the terminal 200 and is closer to the linear expansion coefficient of the intermediate member 101 than the linear expansion coefficient of the terminal 200. The material for the intermediate member 102 is selected so that the intermediate member 102 has a linear expansion coefficient between the linear expansion coefficients of the intermediate member 101 and the terminal 200 and is closer to the linear expansion coefficient of the terminal 200 than the linear expansion coefficient of the intermediate member 101. It may be expected as a result that the relative difference in the amount of deformation caused by thermal expansion between adjacent members in each of the junction regions may be smaller and the stress may be more reduced.

Furthermore, the linear expansion coefficient of the intermediate member 101 may be set on the basis of the linear expansion coefficient of the electrode 76*e* of the heater 70. The intermediate member 101 is provided between the heater 70 and the terminal 200, but when for example the heater 70 is made of ceramic, the linear expansion coefficient of the intermediate member 101 may be a linear expansion coefficient which is not be within the range determined by the linear expansion coefficient of the heater 70 and the linear expansion coefficient of the terminal 200. Ceramic is a so-called brittle material and particularly susceptible to tensile stress. Therefore, the material for the intermediate member 101 can be selected so that the linear expansion coefficient of the intermediate member 101 is smaller than the linear expansion coefficient of the ceramic. Therefore, it may be expected that stress caused by the thermal expansion of each of the members in the junction region 410 may act in a direction which reduces the expansion of the heater 70, so that the heater 70 is less likely to be damaged.

Since in the power feeding arrangement, the multiple intermediate members are stacked between the electrode 76*e* and the terminal 200, the material for each of intermediate members can be selected from a variety of materials with different line expansion coefficients. This also increases the choice of materials for the terminal 200 and may reduce the manufacturing cost of the heater 70 as a whole. According to the embodiment, the number of layers or the materials of the layers to be stacked are not limited, and the linear expansion coefficient of one intermediate member needs only be within the range between the linear expansion coefficient of an intermediate member opposed to an electrode and the linear expansion coefficient of the terminal 200 in a stepwise manner.

Figure 11:
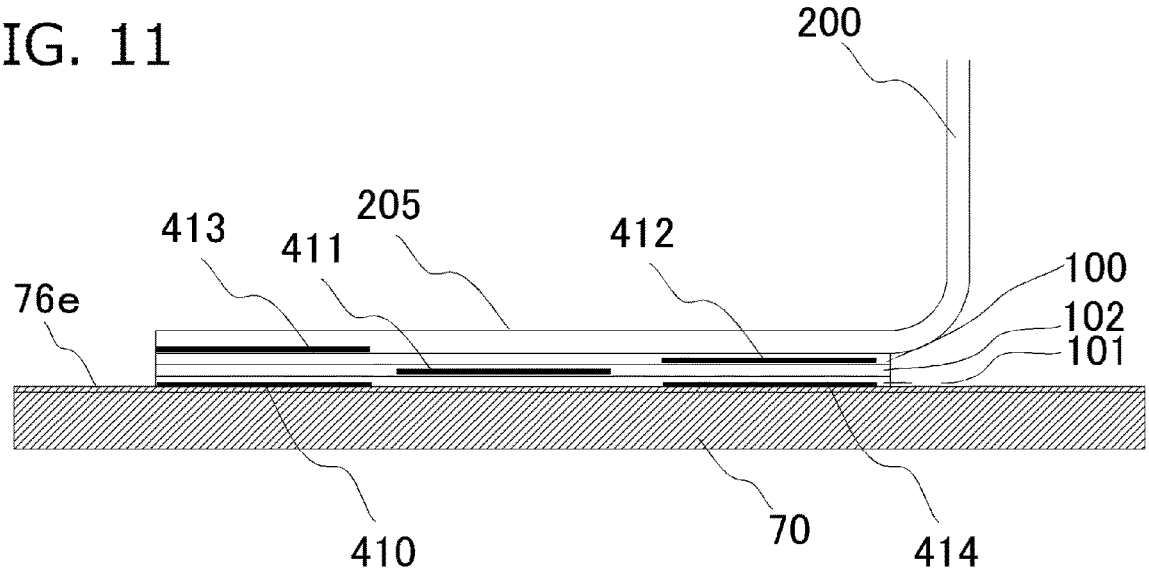
FIG. 11 is a sectional view of another power feeding arrangement according to the third embodiment.

As a modification of the power feeding arrangement according to the embodiment, an arrangement as illustrated in FIG. 11 may be used. Unlike the arrangement illustrated in FIG. 10, two junction regions 510 and 514 are provided between the electrodes 76*e* and the intermediate member 101. There are a junction region 511 where the intermediate member 101 and the intermediate member 102 are bonded, a junction region 512 where the intermediate member 102 and the intermediate member 100 are bonded, and a junction region 513 where the intermediate member 100 and the terminal 200 are bonded. In this example, the junction regions 511, 512, and 513 correspond to the junction regions 411, 412, and 413, respectively. Also according to the modification, the two junction regions provided with an intermediate member therebetween are arranged not to overlap each other when the regions are viewed in a direction orthogonal to the flat surface part of the intermediate member 100. Therefore, the advantageous effects described in connection with the embodiment can also be provided according to the modification.

Fourth Embodiment

Now, a fourth embodiment of the present invention will be described. In the following description, the same components as those of the first embodiment are denoted by the same reference characters, and a detailed description thereof will not be provided. The heater 70 according to the fourth embodiment has the same structure as the first embodiment and illustrated in FIG. 5.

Figure 12A:
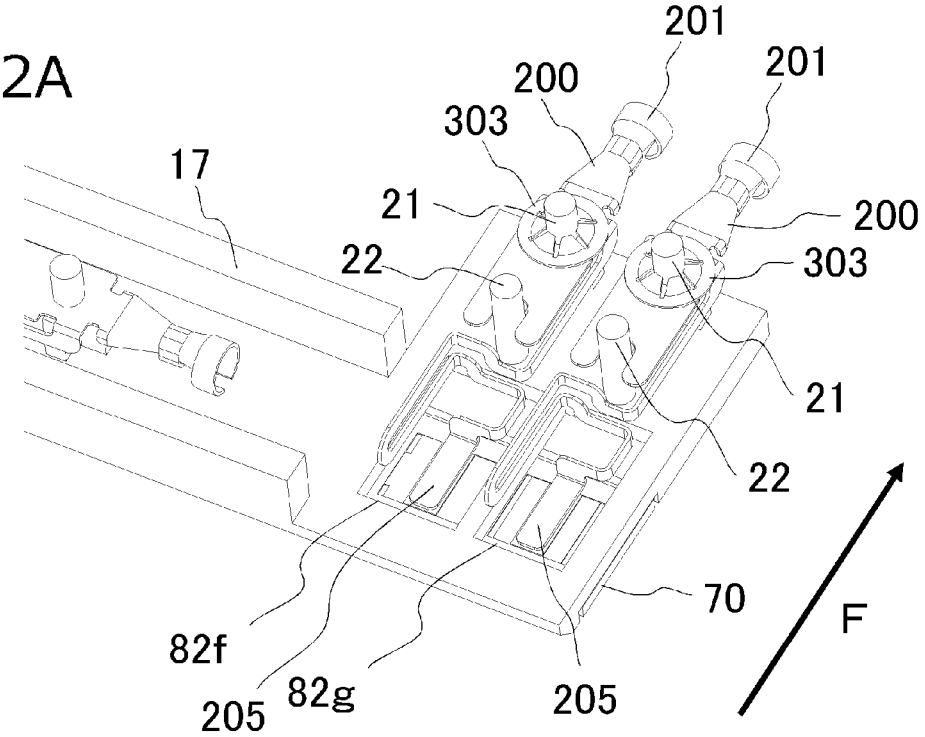
FIGS. 12A and 12B are general views of a power feeding arrangement according to a fourth embodiment of the present invention.
Figure 12B:
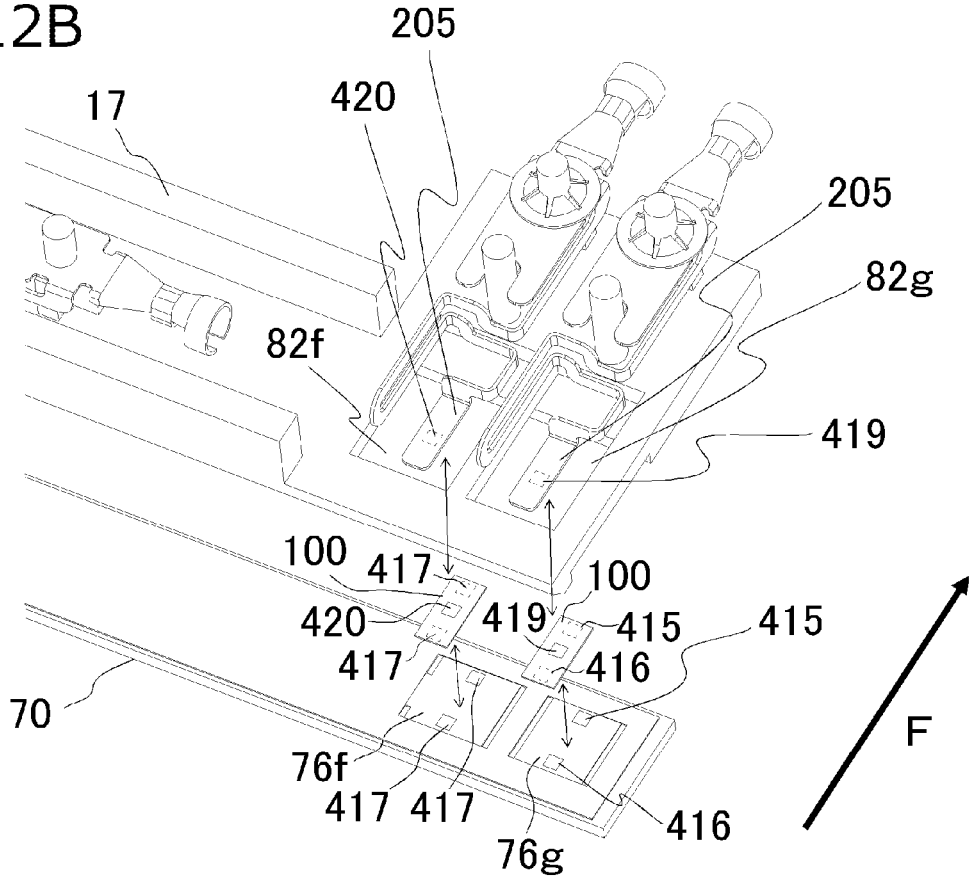

FIGS. 12A and 12B show the power feeding arrangement for the electrodes 76*f* and 76*g* according to the embodiment. Since the power feeding arrangement for the electrodes 76*h* and 76*i* is the same as the power feeding arrangement for the electrodes 76*f* and 76*g*, the power feeding arrangement for the electrodes 76*f* and 76*g* will be described in the following, and the power feeding arrangements of the electrodes 76*h* and 76*i* will not be described. As illustrated in FIG. 12A, a terminal 200 is fixed to a heater holder 17. More specifically, a positioning part 202 (see FIG. 1B) is provided with a hole through which a positioning boss 21 provided in the heater holder 17 is inserted. A rotation stopper 203 is provided with a recess which is fitted with the rotation stop boss 22 provided in the heater holder 17. While the positioning part 202 is placed through the positioning boss 21 and the rotation stopper 203 is fitted with the rotation stop boss 22, a push nut 303 is fitted to the positioning boss 21, so that the terminal 200 is fixed to the heater holder 17.

A bundle wire (not illustrated) is caulked at the clamping part 201 of the terminal 200, and the bundle wire extends in the direction F for transporting a recording material P. A power feeding arrangement according to the embodiment will be described with reference to FIG. 12B. An intermediate member 100 is placed on the electrodes 76*f* and 76*g*, and the electrodes 76*f* and 76*g* and the intermediate member 100 are electrically bonded by ultrasonic bonding. The electrode 76*f* and the intermediate member 100 are bonded in junction regions 415 and 416, and the electrode 76*g* and the intermediate member 100 are bonded in junction regions 417 and 418.

Unlike the first embodiment, the junction regions 415 and 416 and the junction regions 417 and 418 are arranged in alignment in the direction F for transporting a recording material P. The region where the power feeding arrangement for the electrodes 76*f* and 76*g* is provided is a region corresponding to the part on the heater 70 which does not have heat-generating elements 74*a* and 74*b*. Therefore, a space for providing the electrodes 76*f* and 76*g* can be secured as the longitudinal direction of the electrodes 76*f* and 76*g* is aligned with the direction F for transporting the recording material P. Meanwhile, when the longitudinal direction of the electrodes 76*f* and 76*g* is aligned with the longitudinal direction of the heater 70 similarly to the first embodiment, the arrangement of the electrodes 76*f* and 76*g* is the same as that of the electrodes 76*a* to 76*e*. More specifically, as compared to the examples illustrated in FIGS. 12A and 12B, a larger space must be secured in the longitudinal direction of the heater 70 in order to place the electrodes 76*f* and 76*g* therein, which may lead to increase in the size of the image forming apparatus.

In the power feeding arrangement according to the embodiment, the connector 300 can be omitted. At the connector 300, a terminal 302 generates pressurizing force on the connector 300. Therefore, in order to ensure the conductivity between the connector 300 and the electrodes 76*f* to 76*i* by pressurizing force by the terminal 302 in a high temperature environment, a part of titanium copper plated with gold is sometimes used for the terminal 302. Therefore, the use of such part for the terminal 302 may increase the manufacturing cost of the heater 70. According to the embodiment, without the presence of the connector 300, the manufacturing cost of the heater 70 may be reduced. In addition, according to the embodiment, the heater 70 can be reduced in size as compared to the conventional heater by arranging the electrodes 76*f* to 76*i* in the above-described manner.

Although the regions for providing the electrodes 76*f* to 76*i* correspond to the non-heat generating part of the heater 70, the size reduction of the heater may make these regions susceptible to heat generated by the heater 70. However, according to the embodiment, the presence of the junction regions arranged as described can minimize the stress generated by the thermal expansion of each of the members. In this way, even when the heater 70 has a smaller size than the size of the conventional heater, the reliability of the power feeding arrangement will not be impaired.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-232863, filed on Dec. 12, 2018, which is hereby incorporated by reference herein in its entirety.

What is claimed is:

1. An image heating apparatus, comprising:

a heater that includes a substrate having a longitudinal direction which is a direction orthogonal to a direction in which a recording material is transported, a heat-generating element provided on the substrate, and an electrode provided on the substrate and configured to feed electric power to the heat-generating element; and a terminal that is electrically connected to the electrode, wherein, the image heating apparatus heats an image formed on the recording material by heat from the heater, a conductive intermediate member including at least one layer is provided between the terminal and the electrode, the electrode and the intermediate member are fixed with each other, the terminal and the intermediate member are fixed with each other, a first fixing region in which the electrode and the intermediate member are fixed and a second fixing region in which the terminal and the intermediate member are fixed are shifted from each other in the longitudinal direction, the terminal has a greater linear expansion coefficient than that of the substrate, the first fixing region is provided at at least two locations, and the second fixing region is provided between the two first fixing regions when viewed in a direction orthogonal to a flat surface of the intermediate member.

2. The image heating apparatus according to claim 1, wherein the intermediate member has a smaller Young's modulus than that of the heater, and the intermediate member has a greater breaking elongation value than that of the heater.

3. The image heating apparatus according to claim 1, wherein a plurality of the intermediate members are stacked on between the terminal and the electrode, the intermediate members stacked from the electrode toward the terminal have linear expansion coefficients which change stepwise from the linear expansion coefficient of the electrode to the linear expansion coefficient of the terminal within the range between the linear expansion coefficient of the electrode and the linear expansion coefficient of the terminal.

4. The image heating apparatus according to claim 1, wherein the terminal is fixed to a holding member which holds the heater, and the holding member has a linear expansion coefficient different from that of the heater.

5. The image heating apparatus according to claim 1, wherein the first fixing region and the second fixing region do not overlap each other when viewed in a direction orthogonal to a flat surface part of the intermediate member.

6. The image heating apparatus according to claim 1, further comprising:

a tubular film; and a pressurizing member which abuts against the film and forms a nip part for transporting the recording material between the film and itself, wherein the heater is provided in an inner space of the film, and the nip part is formed by the pressurizing member in cooperation with the heater through the film.

7. An image forming apparatus, comprising:

an image forming unit which forms an image on a recording material; and a fixing unit which fixes the image formed on the recording material on the recording material, wherein the fixing unit is the image heating apparatus according to claim 1.

* * * * *